US008813819B2

(12) United States Patent
Yabuhana et al.

(10) Patent No.: US 8,813,819 B2
(45) Date of Patent: Aug. 26, 2014

(54) DIE CHANGE APPARATUS AND DIE CARRYING-IN DEVICE FOR USE IN FLASKLESS MOLDING MACHINE

(76) Inventors: Keisuke Yabuhana, Toyota (JP); Syuichi Furukawa, Toyota (JP); Syozaburo Tsuzuki, Toyota (JP); Eiji Ito, Toyota (JP)

( * ) Notice: Subject to any disclaimer, the term of this patent is extended or adjusted under 35 U.S.C. 154(b) by 0 days.

(21) Appl. No.: 13/576,291

(22) PCT Filed: Mar. 25, 2011

(86) PCT No.: PCT/JP2011/001767

§ 371 (c)(1),
(2), (4) Date: Jul. 31, 2012

(87) PCT Pub. No.: WO2012/131748

PCT Pub. Date: Oct. 4, 2012

(65) Prior Publication Data

US 2014/0000833 A1 Jan. 2, 2014

(51) Int. Cl.
*B22C 11/10* (2006.01)
*B22D 47/02* (2006.01)

(52) U.S. Cl.
CPC ..... *B22C 11/10* (2013.01); *B22D 47/02* (2013.01)
USPC ..... 164/323; 164/18; 164/27; 164/29

(58) Field of Classification Search
CPC ..... B22C 11/02; B22C 11/10; B22D 47/02
USPC ..... 164/18, 27, 29, 323
See application file for complete search history.

(56) References Cited

U.S. PATENT DOCUMENTS 4,737,095 A * 4/1988 Hehl ..... 425/190
4,976,601 A 12/1990 Tsuruta et al.
6,779,586 B2 * 8/2004 Hunter et al. ..... 164/323

FOREIGN PATENT DOCUMENTS

| | | |
|---|---|---|
| JP | 59-21448 | 7/1982 |
| JP | 62-137142 | 6/1987 |
| JP | 02-284743 | 4/1989 |
| JP | 03-18533 | 3/1991 |

* cited by examiner

*Primary Examiner* — Keith Walker
*Assistant Examiner* — Kevin E Yoon
(74) *Attorney, Agent, or Firm* — DNL Zito; Benjamin C. Deming; Joseph J. Zito

(57) ABSTRACT

Provided are a die change apparatus for use in a flaskless molding machine capable of mounting dies for producing a casting mold on die bases even when the dies have a great thickness, and a die carrying-in device used therein. The die carrying-in device comprises a first movable plate provided so as to be slidable along a die carrying-in direction toward a first die base, and a second movable plate placed so as to face the first movable plate in a standby position. A die drive source causes dies which have been positioned in a height direction to be detached from the movable plates, move toward the die bases, and be supported by clamping elements. An intersection drive source causes at least one of the first movable plate and the second movable plate to move in a direction to intersect the die carrying-in direction independently of the other.

4 Claims, 10 Drawing Sheets

DIE CHANGE APPARATUS AND DIE CARRYING-IN DEVICE FOR USE IN FLASKLESS MOLDING MACHINE

CROSS REFERENCE TO RELATED APPLICATIONS

This application is a National Stage of International Application No. PCT/JP2011/001767 filed on Mar. 25, 2011.

TECHNICAL FIELD

The present invention relates to a die change apparatus and a die carrying-in device for use in a flaskless molding machine for producing a flaskless sand casting mold.

BACKGROUND ART

Conventionally, flaskless molding machines for producing flaskless sand casting molds have been provided. PTL 1 discloses a die change apparatus for use in a flaskless molding machine. This apparatus comprises a flaskless molding machine capable of being equipped with a first die and a second die capable of producing a flaskless casting mold, and a die carrying-in device and a die carrying-out device which face each other across the flaskless molding machine. The flaskless molding machine includes a first die base having a first mounting base and a second die base having a second mounting base. According to PTL 1, a movable plate having the first die and a movable plate having the second die are simultaneously inserted into a space between the first die base and the second die base. Therefore, there are restrictions on thickness of the first die to be mounted on the first die base and thickness of the second die to be mounted on the second die base. Consequently, a first die and second die having a great thickness cannot be employed. Therefore, there is a limit in increasing casting mold design flexibility.

CITATION LIST

Patent Literature

PTL 1: Japanese Unexamined Patent Publication No. S62-137142

SUMMARY OF INVENTION

Technical Problem

The present invention has been made in view of the above-mentioned circumstances. It is an object of the present invention to provide a die change apparatus and a die carrying-in device for use in a flaskless molding machine which is advantageous in mounting dies for producing a casting mold out die bases even when the dies have a great thickness.

Solutions to Problem (1) A die change apparatus for use in a flaskless molding machine (hereinafter also referred to as a molding machine) according to a first aspect of the present invention is a die change apparatus for use in a flaskless molding machine, comprising a flaskless molding machine capable of being equipped with a first die and a second die for producing a flaskless casting mold, and a die carrying-in device and a die carrying-out device provided so as to face each other across the flaskless molding machine, (i) the flaskless molding machine comprising:

(a) a first die base having a first mounting surface and a second die base having a second mounting surface;

(b) a first clamping element provided on the first die base and being switchable between a clamp position to fix the first die on the first mounting surface and an unclamp position to release clamping and separate the first die from the first mounting surface; and (c) a second clamping element provided on the second die base and being switchable between a clamp position to fix the second die on the second mounting surface and an unclamp position to release clamping and separate the second die from the second mounting surface, and (ii) the die carrying-in device comprising:

(a) a first movable plate provided so as to be slidable along a die carrying-in direction toward the first mounting surface of the first die base, and having a first positioning portion for detachably supporting the first die and positioning the first die in a height direction;

(b) a second movable plate placed so as to face the first movable plate in a standby position, provided so as to be slidable along the die carrying-in direction toward the second mounting surface of the second die base independently of the first movable plate, and having a second positioning portion for detachably supporting the second die and positioning the second die in the height direction;

(c) a die drive source for causing the first die which has been positioned in the height direction by the first positioning portion to be detached from the first movable plate, move along the die carrying-in direction toward the first mounting surface of the first die base, and be supported by the first clamping element, and causing the second die which has been positioned in the height direction by the second positioning portion to move along the die carrying-in direction toward the second mounting surface of the second die base independently of the first die and be supported by the second clamping element; and (d) an intersection drive source for causing at least one of the first movable plate and the second movable plate to move in a direction to intersect the die carrying-in direction independently of the other.

(2) A die carrying-in device according to a second aspect of the present invention is a die carrying-in device for inserting a first die and a second die capable of producing a flaskless casting mold into a flaskless molding machine capable of being equipped with the first die and the second die, (i) the flaskless molding machine comprising:

(a) a first die base having a first mounting surface and a second die base having a second mounting surface;

(b) a first clamping element provided on the first die base and being switchable between a clamp position CA to fix the first die on the first mounting surface and an unclamp position CB to release clamping and separate the first die from the first surface;

(c) a second clamping element provided on the second die base and being switchable between a clamp position CA to fix the second die on the second mounting surface and an unclamp position CB to release clamping and separate the second die from the second mounting surface, and (ii) the die carrying-in device comprising:

(a) a first movable plate provided so as to be slidable along a die carrying-in direction toward the first mounting surface of the first die base, and having a first positioning portion for detachably supporting the first die and positioning the first die in a height direction;

(b) a second movable plate placed so as to face the first movable plate in a standby position, provided so as to be slidable along the die a second positioning portion for detachably supporting the second die and positioning the second die in the height direction;

(c) a die drive source for causing the first die which has been positioned in the height direction by the first positioning portion to be detached from the first movable plate, move along the die carrying-in direction toward the first mounting surface of the first die base, and be supported by the first clamping element, and causing the second die which has been positioned in the height direction by the second positioning portion to move along the die carrying-in direction toward the second mounting surface of the second die base independently of the first die, and be supported by the second clamping element; and (d) an intersection drive source for causing at least one of the first movable plate and the second movable plate to move in a direction to intersect the die carrying-in direction independently of the other.

(3) According to the present invention, the first positioning portion of the first movable plate detachably supports the first die and positions the first die in the height direction. When the die drive source is actuated in such a situation, the first movable plate having the first die can slide along the die carrying-in direction toward the first mounting surface or the first die base independently of the second movable plate having the second die. This enables the first die to be mounted on the first mounting surface of the first die base.

On the other hand, the second positioning portion of the second movable plate detachably supports the second die and positions the second die in the height direction. When the die drive source is actuated in such a situation, the second movable plate having the second movable plate having the first die. This enables the second die to be mounted on the second mounting surface of the second die base.

According to the present invention thus constructed, after one of the first die and the second die is mounted on its die base, the die-mounted die base of the first die base and the second die base is withdrawn to a retracted position. After that, the intersection drive source causes the other die-having movable plate of the first movable plate and the second movable plate to slide in a direction to intersect the die carrying-in direction. This aligns the position of the movable plate having the other die with the position of the other die base in the direction to intersect the die insertion direction in a planar view. When the die drive source is actuated in such a situation, the movable plate having the other die slides along the die carrying-in direction toward the mounting surface of the other die base. This enables the other die to be mounted on the mounting surface of the other die base.

Advantageous Effects of Invention

As mentioned before, according to the present invention, the first movable plate having a first die and the second movable plate having a second die are slidable toward the respective die bases independently of each other.

According to the present invention thus constructed, after one of the first die and the second is mounted on its die base, the die-mounted die base of the first die base and the second die base is withdrawn to a retracted position. After that, the intersection drive source causes the other die-having movable plate of the first movable plate and the second movable plate to move in the direction to intersect the die carrying-in direction. This aligns the position of the other the under such a situation, the other die of the first die and the second die is mounted on its die base. According to the present invention thus constructed, the first movable plate having the first die and the second movable plate having the second die are inserted between the die bases independently and individually of each other and the first die and the second die are mounted on the die bases independently and individually of each other. Therefore, change of the first die or the second die having a great thickness can be achieved without excessively increasing a space between the first die base and the second die base in the molding machine. That is to say, while easing restrictions on the space between the first die base and the second die base in the molding machine, change of the first die or second die having a great thickness can be realized.

REFERENCE SIGNS LIST

Figure 1:
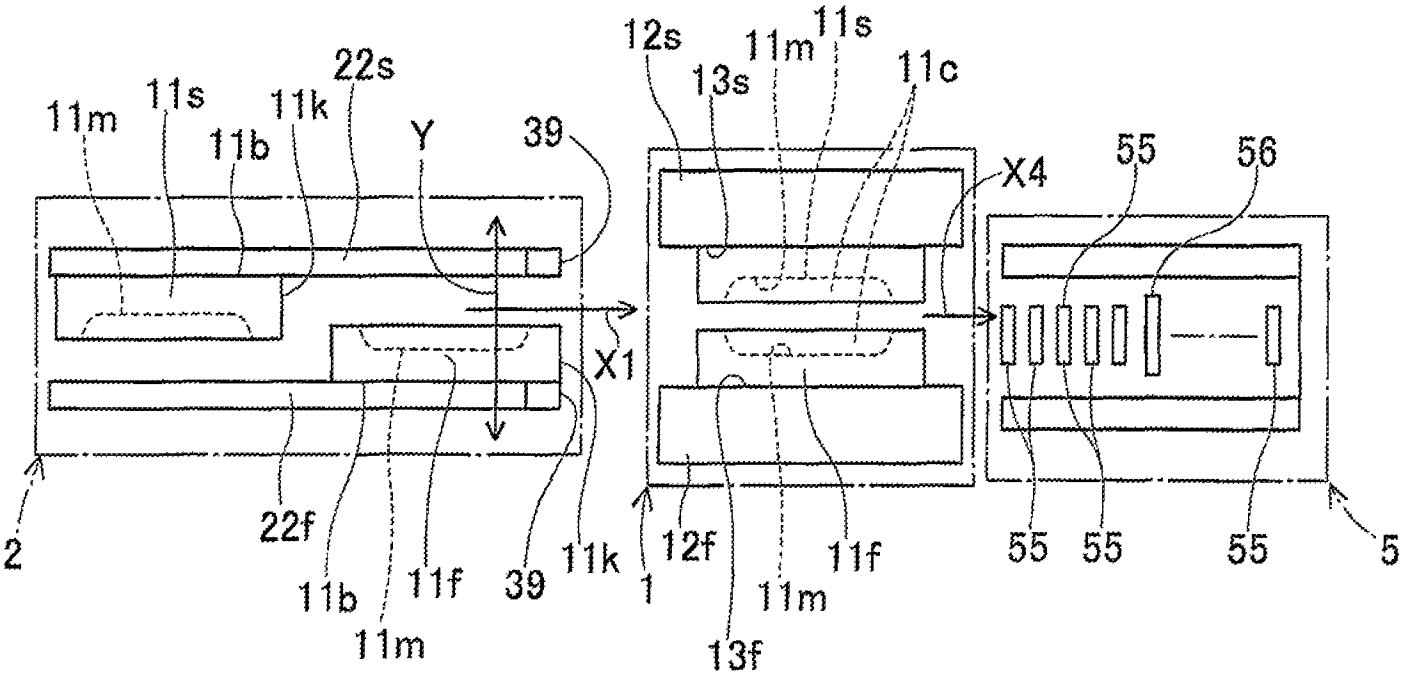
FIG. 1 is a plan view schematically showing a concept of a change apparatus according to Example 1.

1: a molding machine, 11*f*: a first die, 11*s*: a second die, 12*f*: a first die base, 12*s*: a second die base, 13*f*: a first mounting surface, 13*s*: a second mounting surface, 14*f*: first clamping elements, 14*s*: second clamping elements, 15*f*: first clamping members, 15*s*: second clamping members, 16*f*: first guide grooves, 16*s*: second guide grooves, 18*f*: first engaging portions, 18*s*: second engaging portions, 2: a die carrying-in device, 22*f*: a first movable frame, 22*s*: a second movable frame, 29*f*: a first slide drive source, 29*s*: a second slide drive source, 33*f*: a first movable plate, 33*s*: a second movable plate, 39: position restricting portions, 5: a die carrying-out device, 51: a rotary frame, 54: a tilt drive source, 56: a stopper, 57: a stopper drive source.

DESCRIPTION OF EMBODIMENT

According to a preferred embodiment, a die carrying-in device comprises a fixed frame, a first movable frame and a second movable frame provided on the fixed frame so as to be slidable along a die carrying-in direction, a first slide drive source provided on the fixed frame and causing the first movable frame to slide along the die carrying-in direction independently of the second frame, and a second slide drive source provided on the fixed frame and causing the second movable frame to slide along the die carrying-in direction independently of the first movable frame.

According to a preferred embodiment, the first clamping element comprises a first clamping member provided on the first die base and being switchable between the clamp position to fix the first die on the first mounting surface and the unclamp position to release clamping and separate the first die from the first mounting surface, a first guide groove provided on the first clamping member and guiding a first engaging portion provided on a rear surface of the first die along the die carrying-in direction, and a first clamp drive source for switching the first clamping member between the clamp position and the unclamp position.

On the other hand, the second clamping element comprises a second clamping member provided on the second die base and being switchable between the clamp position to fix the second die on the second mounting surface and the unclamp position to release clamping and separate the second die from the second mounting surface, a second guide groove provided on the second clamping member and guiding a second engaging portion provided on a rear surface of the second die along the die carrying-in direction, and a second clamp drive source for switching the second clamping member between the clamp position and the unclamp position.

EXAMPLE 1

An embodiment of the present invention will be described with reference to the drawings. In a plan view of FIG. 1, a die change apparatus comprises a flaskless molding machine 1 to be equipped with a first die 11*f* and a second die 11*s* capable of producing a flaskless casting mold formed of casting sand (hereinafter also referred to as a mold), and a die carrying-in device 2 and a die carrying-out device 5 which face each other across the flaskless molding machine 1 in a die carrying-in direction (the direction of the arrow X1). The die carrying-in device 2 serves to cause the dies 11*f*, 11*s* to move in the direction of the arrow X1 and be carried into the molding machine 1. The die carrying-out device 5 serves to receive the dies which have been carried out from the molding machine 1 in the direction of the arrow X4.

Figure 12:
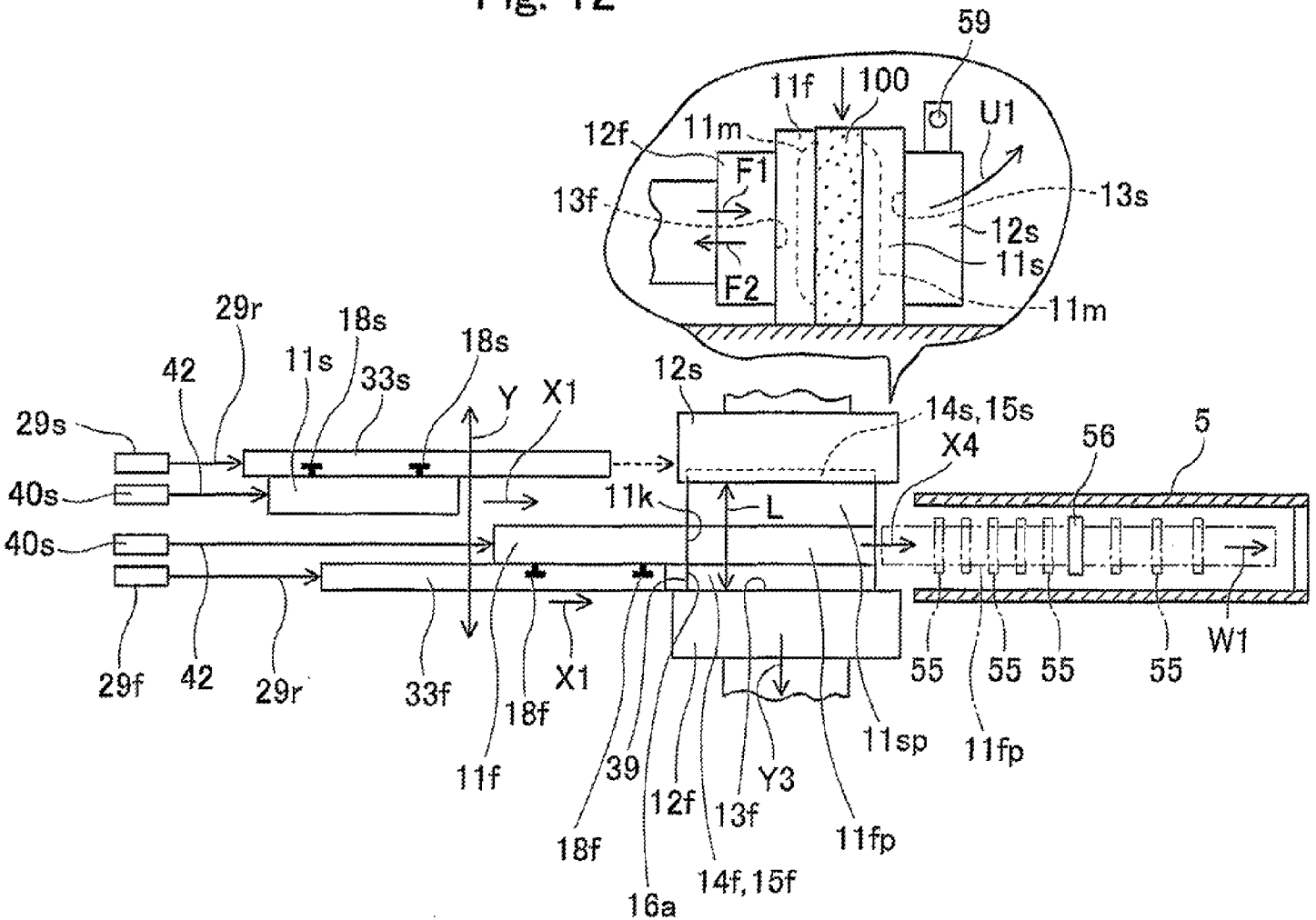
FIG. 12 is a plan view schematically showing a concept in which the first die is mounted on the first die base by means of the first movable plate.

The molding machine 1 will be described. As shown in FIG. 1, the molding machine 1 serves to produce a flaskless casting mold and includes a first die base 12*f* having a flat first mounting surface 13*f*, and a second die base 12*s* having a flat die mounting surface 13*s*. The die bases 12*f*, 12*s* can move in a die closing direction and a die opening direction (the direction of the arrow Y, which is a direction to intersect the die carrying-in direction (the direction of the arrow X1) in a plan view). In producing a casting mold, the first mounting surface 13*f* and the second mounting surface 13*s* face each other. A first die 11*f* having a shape-forming surface 11*m* for forming a cavity 11*c* is mounted on the first mounting surface 13*f*. The second die 11*s* having a shape-forming surface 11*m* is mounted on the second mounting surface 13*s*. As shown in FIG. 12, after a mold 100 is produced, the second die base 12*s* can be withdrawn while being turned in a retracted direction (the direction of the arrow U1) around a rotary shaft 59. After the second die base 12*s* is withdrawn, the first die base 12*f* advances in the direction of the arrow F1 and then the mold 100 advances and gets demolded. After the mold 100 is demolded, the first die base 12*f* retreats in the direction of the arrow F2 and returns to a home position.

Figure 2:
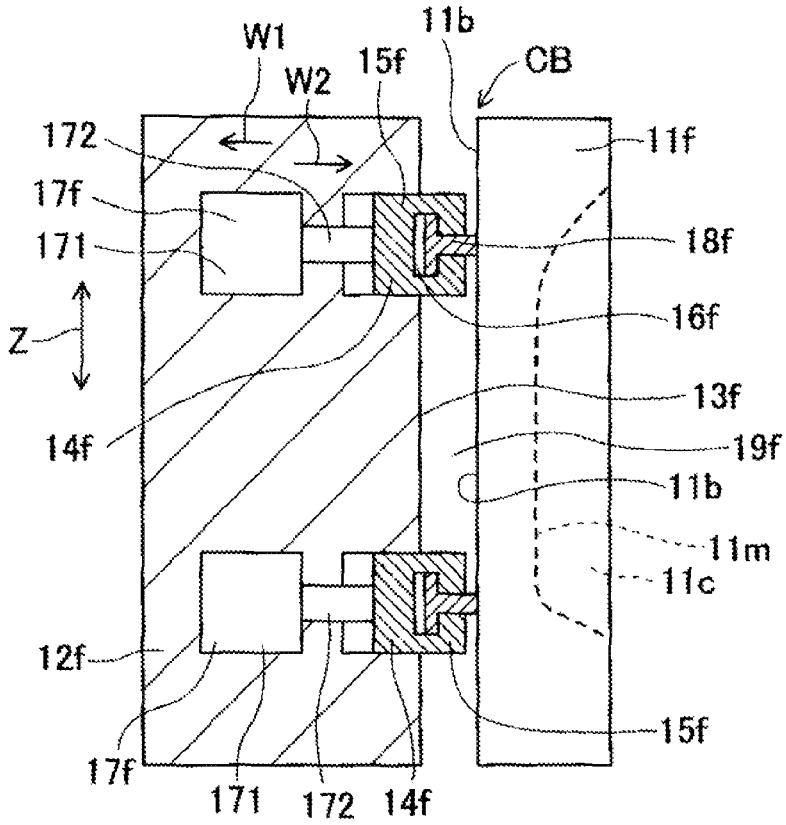
FIG. 2 is a cross-sectional view schematically showing a concept in which a first die is separated from a first mounting surface of a first die base.
Figure 3:
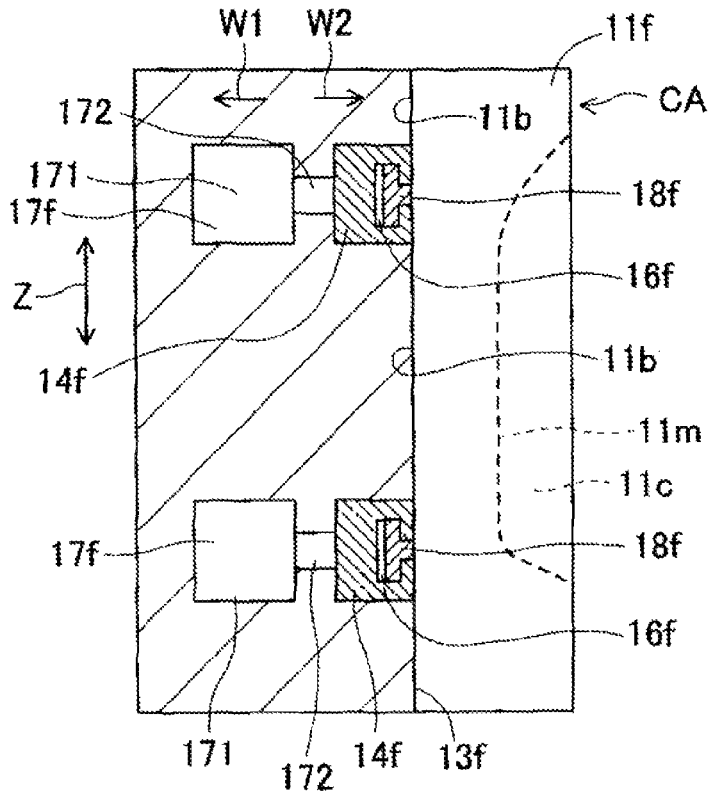
FIG. 3 is a cross-sectional view schematically showing a concept in which the first die is clamped onto the first mounting surface of the first die base.
Figure 6:
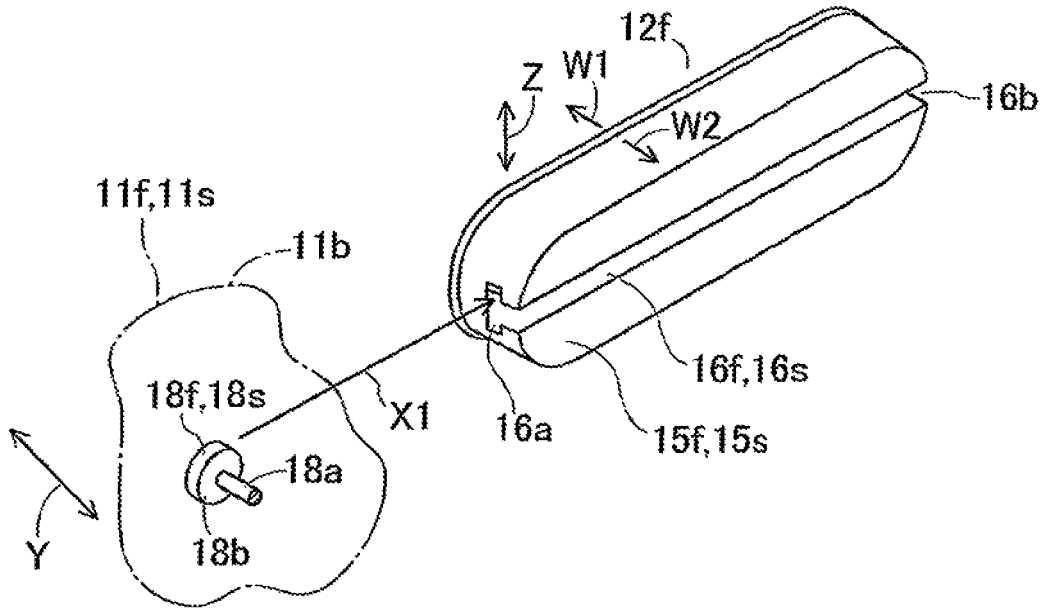
FIG. 6 is a perspective view schematically showing a concept in which an engaging portion of a die is moved in a die carrying-in direction and inserted into a guide groove of a clamping member.

FIG. 2 and FIG. 3 show a plurality of first clamping elements 14*f* provided on the first die base 12*f*. As shown in FIG. 2 and FIG. 3, the plurality of (two) first clamping elements 14*f* are arranged on the first die base 12*f* in a height direction (the direction of the arrow Z), and are switchable between a clamp position CA to fix the first die 11*f* on the first mounting surface 13*f* and an unclamp position CB to release clamping and separate the first die 11*f* from the first mounting surface 13*f*. Each of the first clamping elements 14*f* comprises a first clamping member 15*f*, a first guide groove 16*f*, and a first clamp drive source 17*f*. The first clamping member 15*f* is switchable between the clamp position CA to fix the first die 11*f* on the first mounting surface 13*f*, and the unclamp position CB to release clamping and separate the first die 11*f* from the first mounting surface 13*f*. As shown in FIG. 6, the first guide groove 16*f* is provided on the first clamping member 15*f* and guides a first engaging portion 18*f* provided on a rear surface 11*b* of the first die 11*f*. The first engaging portion 18*f* is constituted by a T-bolt provided on the rear surface 11*b* of the first die 11*f* and has a shank portion 18*a* and a head portion 18*b*. As shown in FIG. 2 and FIG. 3, the first clamp drive source 17*f* has a body 171 and an extensible rod 172. As shown in FIG. 6, the first guide groove 16*f* extends along the die carrying-in direction (the direction of the arrow X1) and along a horizontal direction so as to be capable of being inserted by the first engaging portion 18*f* of the first die 11*f*, and its leading end 16*a* and its trailing end 16*b* are open. It should be noted that the first die base 12*f* faces the second die base 12*s*, but basically has a common structure with the second die base 12*s*. The first clamping elements 14*f* of the first die base 12*f* face the second clamping elements 14*s* of the second die base 12*s*, but basically have a common structure with the second clamping elements 14*s* of the second die base 12*s*.

Figure 4:
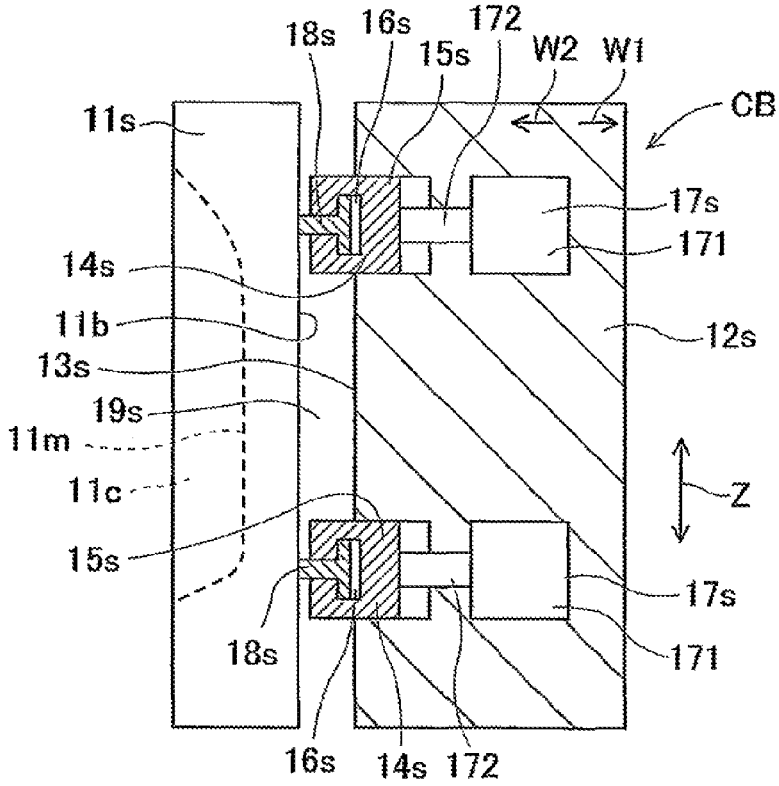
FIG. 4 is a cross-sectional view schematically showing a concept in which a second die is separated from a second mounting surface of a second die base.
Figure 5:
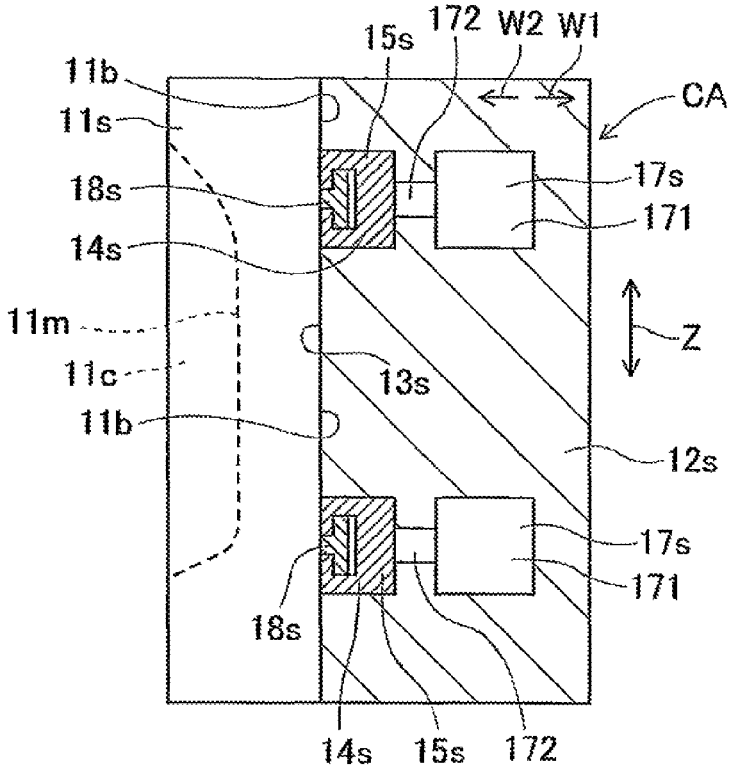
FIG. 5 is a cross-sectional view schematically showing a concept in which the second die is clamped onto the second mounting surface of the second die base.

FIG. 4 and FIG. 5 show a plurality of second clamping elements 14*s* provided on the second die base 12*s*. As shown in FIG. 4 and FIG. 5, the second clamping elements 14*s* are provided on the second die base 12*s* and are switchable between a clamp position CA to fix the second die 11*s* on the second mounting surface 13*s* and an unclamp position CB to release clamping and separate the second die 11*s* from the second mounting surface 13*s*. Each of the second clamping elements 14*s* comprises a second clamping member 15*s*, a second guide groove 16*s*, and a second clamp drive source 17*s*. The plurality of (two) second clamping members 15*s* are arranged in a height direction (the direction of the arrow Z) and are switchable between the clamp position CA to fix the second die 11*s* on the second mounting surface 13*s* and the unclamp position CB to release clamping and separate the second die 11*s* from the second mounting surface 13*s*. The second guide grooves 16*s* are respectively provided on the second clamping members 15*s* and guide second engaging portions 18*s* provided on a rear surface 11*b* of the second die 11*s*. The second clamp drive sources 17*s* switch the second clamping members 15*s* between the clamp position CA and the unclamp position CB. Each of the second clamp drive sources 17*s* has a body 171 and an extensible rod 172. The second engaging portions 18*s* are provided on the rear surface 11*b* of the second die 11*s*, and each of the second engaging portions 18*s* is constituted by a T-bolt and has a shank portion 18*a* and a head portion 18*b* (see FIG. 6). It should be noted that FIG. 6 shows one of the first guide grooves 16*f*. Since the first guide grooves 16*f* and the second guide grooves 16*s* have a common structure, FIG. 6 also shows one of the second guide grooves 16*s*. As shown in FIG. 6, the second guide groove 16*s* extends along the die carrying-in direction (the direction of the arrow X1) and along the horizontal direction so as to be capable of being inserted by one of the second engaging portions 18*s*, and its leading end 16*a* and its trailing end 16*b* are open.

Figure 7:
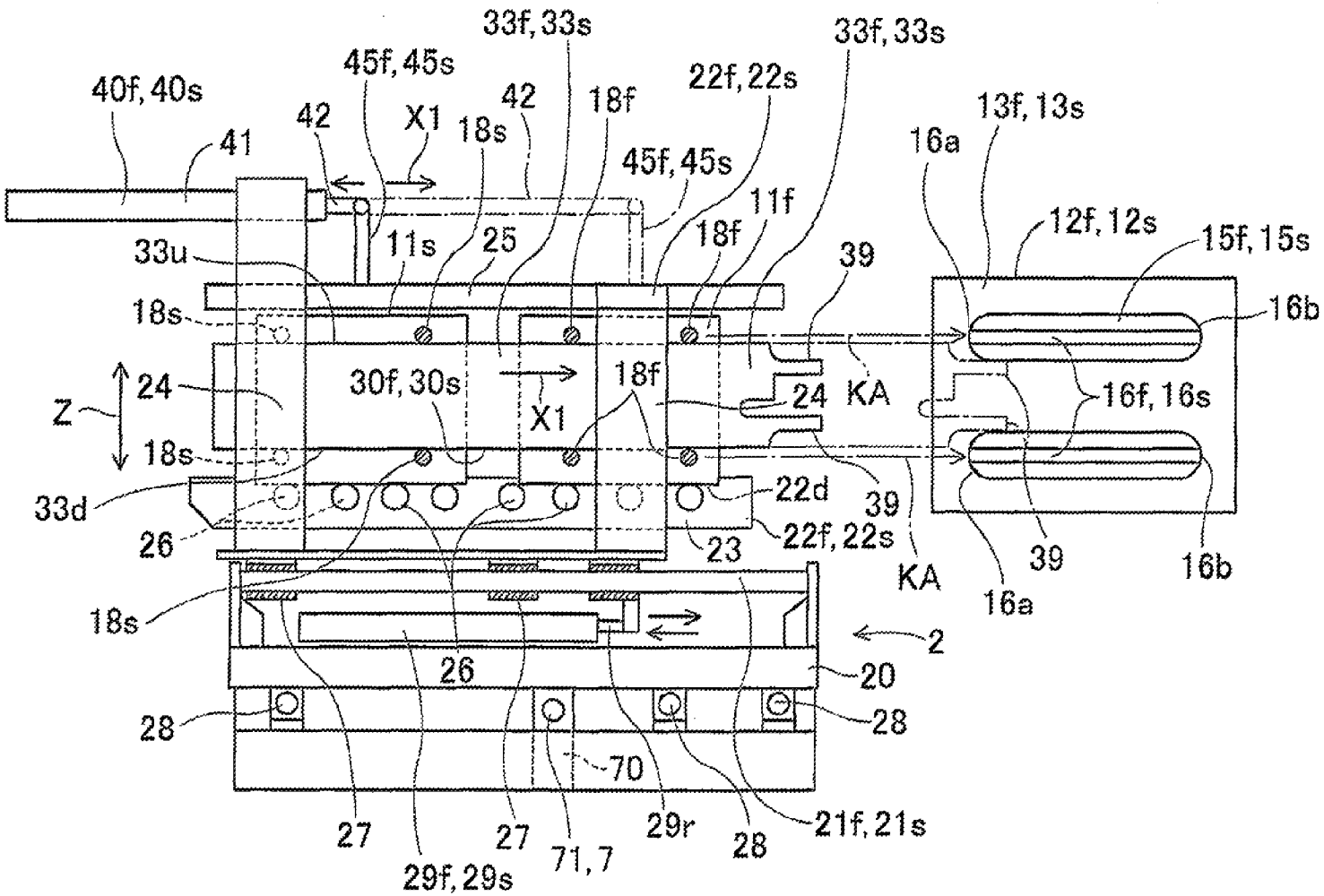
FIG. 7 is a front elevational view schematically showing a concept in which a movable plate holding a die is brought in the vicinity of clamping elements of a die base.

The die carrying-in device 2 will be described. FIG. 7 shows a first movable frame 22*f*. Since the first movable frame 22*f* and a second movable frame 22*s* have a common structure, FIG. 7 also shows the second movable frame 22*s*. As shown in FIG. 7, a body frame 20 of the device 2 has a rod-shaped first guide shaft 21*f* extending along the die carrying-in direction (the direction of the arrow X1). The first movable frame 22*f* is provided on the first guide shaft 21*f* so as to be slidable along the die carrying-in direction. The first movable frame 22*f* comprises a lower frame 23, vertical frames 24 fixed to the lower frame 23, an upper frame 25 fixed to the vertical frames 24. A first movable plate 33*f* is fixed to the first movable frame 22*f*. The lower frame 23 has a plurality of guide rollers 26 on which a lower surface 22*d* of the first die 11*f* is to be placed, and a plurality of guide portions 27 to be moved along the guide shafts 21*f*, 21*s*. A first slide drive source 29*f* is provided on the body frame 20 for causing the first movable frame 22*f* to slide along the die carrying-in direction (the direction of the arrow X1). The body frame 20 can be moved along a plurality of main guide shafts 28 in a direction normal to the sheet of FIG. 7.

The structure of the second movable frame 22*s*, a second guide shaft 21*s* and so on will be described also with reference to FIG. 7 because it is common with the structure of the first movable frame 22*f*, the first guide shaft 21*f* and so on. As shown in FIG. 7, the body frame 20 has the rod-shaped second guide shaft 21*s* extending along the die carrying-in direction (the direction of the arrow X1). The second movable frame 22*s* is provided on the second guide shaft 21*s* so as to be slidable along the die carrying-in direction (the direction of the arrow X1). A second slide drive source 29*s* is provided on the body frame 20 for causing the second movable frame 22*s* to slide along the die carrying-in direction (the direction of the arrow X1). The first slide drive source 29*f* and the second slide drive source 29*s* can be actuated independently of each other. Therefore, the movable frame 22*f* having the first die 11*f* and the movable frame 22*s* having the second die 11*s* can be driven along the die carrying-in direction (the direction of the arrow X1) independently of each other.

Figure 8:
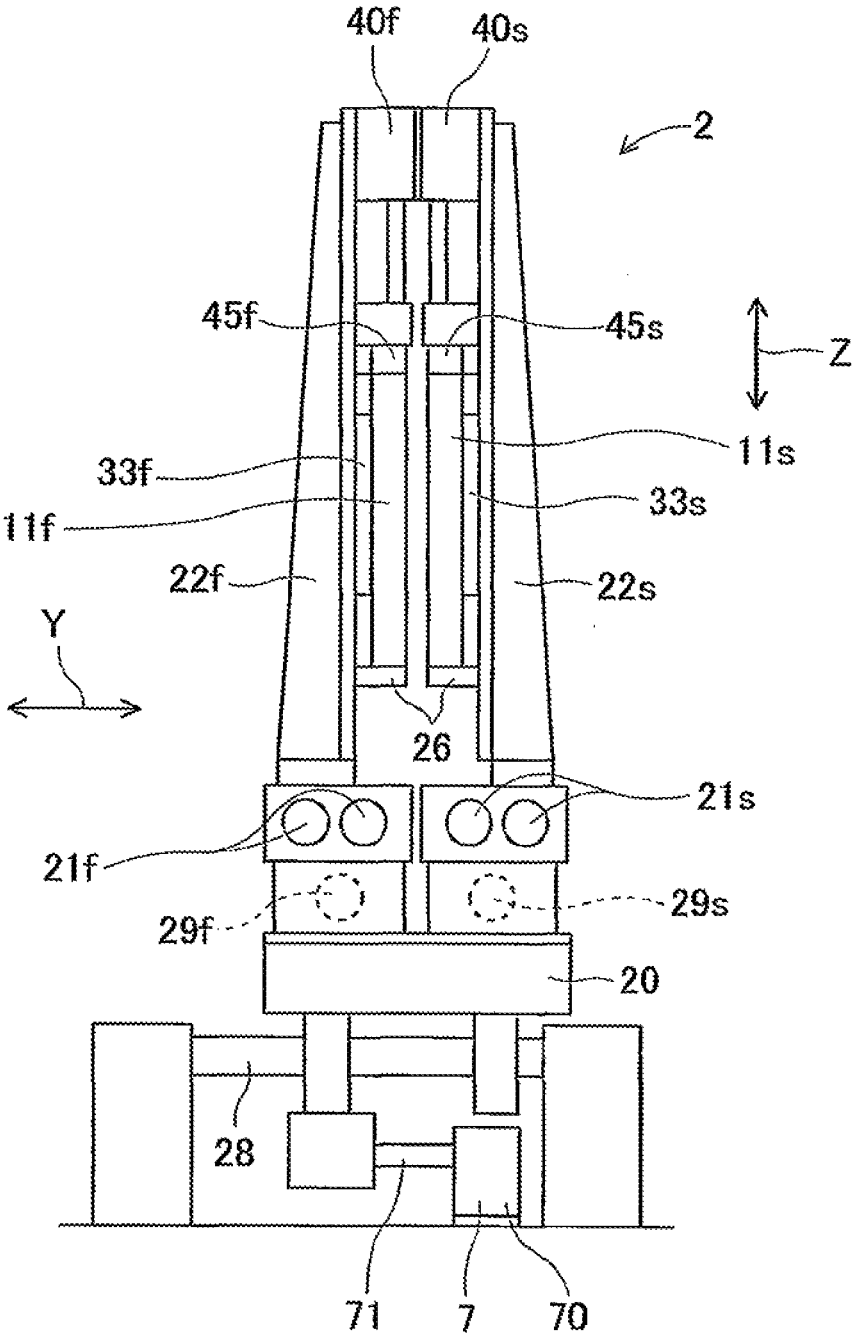
FIG. 8 is a view showing a first movable frame holding a first die and a second movable frame holding a second die in a different direction.

As shown in FIG. 8, the die carrying-in device 2 includes a first die drive source 40*f* and a second die drive source 40*s* as die drive sources. The first die drive source 40*f* has a die engaging element 45*f* to be engaged with the first die 11*f* and causes the first die 11*f* to move in the die carrying-in direction (the direction of the arrow X1). The second die drive source 40*s* has a die engaging element 45*s* to be engaged with the second die 11*s* and causes the second die 11*s* to move in the die carrying-in direction (the direction of the arrow X1).

Figure 9:
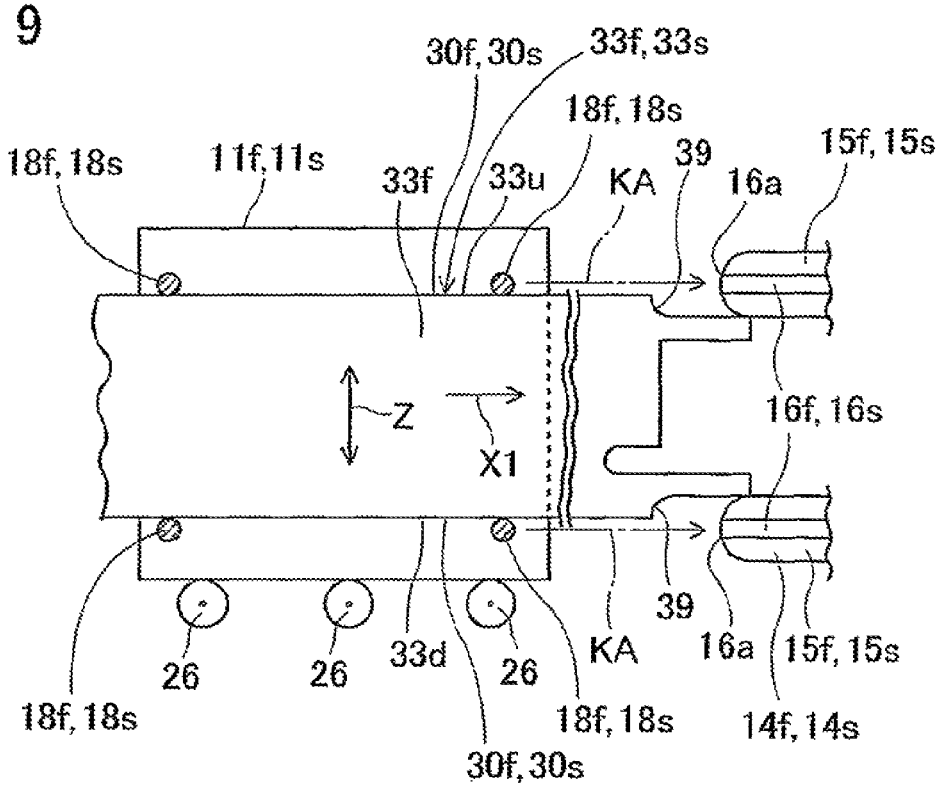
FIG. 9 is a view showing a concept in which position restricting portions of a movable plate holding a die are positioned by clamping members.
Figure 10:
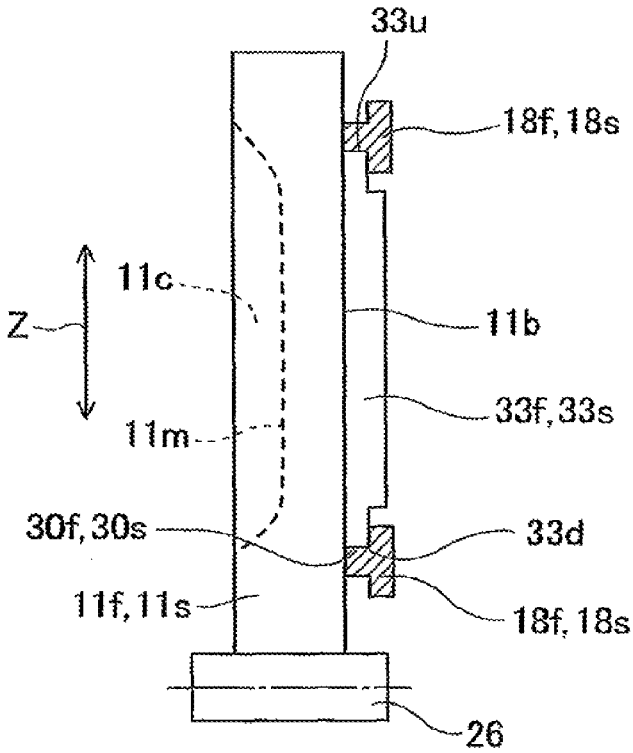
FIG. 10 is a view showing a concept in which engaging portions of a die are positioned in a height direction by a movable plate.

As shown in FIG. 7, the first movable plate 33*f* is held by the first movable frame 22*f* and provided so as to be slidable along the die carrying-in direction (the direction of the arrow X1) toward the first mounting surface 13*f* of the first die base 12*f* and along a horizontal direction. As shown in FIG. 9 and FIG. 10, a lower surface 33*d* and an upper surface 33*u* (especially the lower surface 33*d*) of the first movable plate 33*f* serve as first positioning portions 30*f* which determine the position of the first engaging portions 18*f* of the first die 11*f* in the height direction (the direction of the arrow Z) while detachably supporting the first die 11*f*. The first positioning portions 30*f* of the first movable plate 33*f* get engaged with the first engaging portions 18*f* fixed on the rear surface 11*f* of the first die 11*f*, thereby determining the position of the first die 11*f* in the height direction (the direction of the arrow Z).

As shown in FIG. 7, the second movable plate 33*s* is held by the second movable frame 22*s* and provided so as to be slidable along the die carrying-in direction (the direction of the arrow X1) toward the second mounting surface 13*s* of the second die base 12*s* and along the horizontal direction. As shown in FIG. 9 and FIG. 10, a lower surface 33*d* and an upper surface 33*u* (especially the lower surface 33*d*) of the second movable plate 33*s* serve as second positioning portions 30*s* which determine the position of the second die 11*s* in the height direction (the direction of the arrow Z) while detachably supporting the second die 11*s*. The second positioning portions 30*s* determine the position of the second die 11*s* in the height direction (the direction of the arrow Z) while detachably supporting the second die 11*s*, thereby determining the position of the second die 11*s* in the height direction (the direction of the arrow Z).

As shown in FIG. 7, a plurality of position restricting portions 39 are formed at fore ends of the first movable plate 33*f* and the second movable plate 33*s*. The position restricting portions 39 are fitted to the leading ends 16*a* of the clamping members 15*f*, 15*s* of the clamping elements 14*f*, 14*s*, thereby determining the position of the movable plates 33*f*, 33*s*. The plurality of (two) position restricting portions 39 are arranged in the height direction (the direction of the arrow Z). When the first movable plate 33*f* and the second movable plate 33*s* slide in the die carrying-in direction (the direction of the arrow X1), the position restricting portions 39 get engaged with the leading ends 16*a* of the clamping members 15*f*, 15*s* of the clamping elements 14*f*, 14*s*, thereby determining the position of the first die 11*f* and the second die 11*s* in the height direction (the direction of the arrow Z). In this case, the movable plates 33*f*, 33*s* cannot move any further in the direction of the arrow X1. That is to say 1 the first engaging portions 18*f* of the first die 11*f* move along tracks KA and well fitted into and guided by the first guide grooves 16*f* of the first clamping elements 14*f*. The second engaging portions 18*s* of the second die 11*s* move along tracks KA and well fitted into and guided by the second guide grooves 16*s* of the second clamping elements 14*s*.

As shown in FIG. 7, the first die drive source 40*f* comprises a body 41 and an extensible rod 42. When the first die drive source 40*f* is actuated to extend the rod 42 in the direction of the arrow X1, the first die 11*f* which has been positioned in the height direction (the direction of the arrow Z) by the first positioning portions 30*f* is detached from the first movable plate 33*f* and move along the die carrying-in direction (the direction of the arrow X1) toward the first mounting surface 13*f* of the first die base 12*f*. The second die drive source 40*s* comprises a body 41 and an extensible rod 42. When the second die drive source 40*s* is actuated to extend the rod 42 in the direction of the arrow X1, the second die 11*s* which has been positional in the height direction by the second positioning portions 30*s* is detached from the second movable plate 33*s* and move along the die carrying-in direction (the direction of the arrow X1) toward the second mounting surface 13*s* of the second die base 12*s*.

As shown in FIG. 8, an intersection drive source 7 comprises a body 70 and an extensible rod 71. When the rod 71 of the intersection drive source 7 is extended or contracted in the direction of the arrow Y, the body frame 20, which integrally holds the first movable frame 22*f* and the second movable frame 22*s*, integrally moves in a direction (the direction of the arrow Y) to intersect the die carrying-in direction (the direction of the arrow X1).

Figure 11:
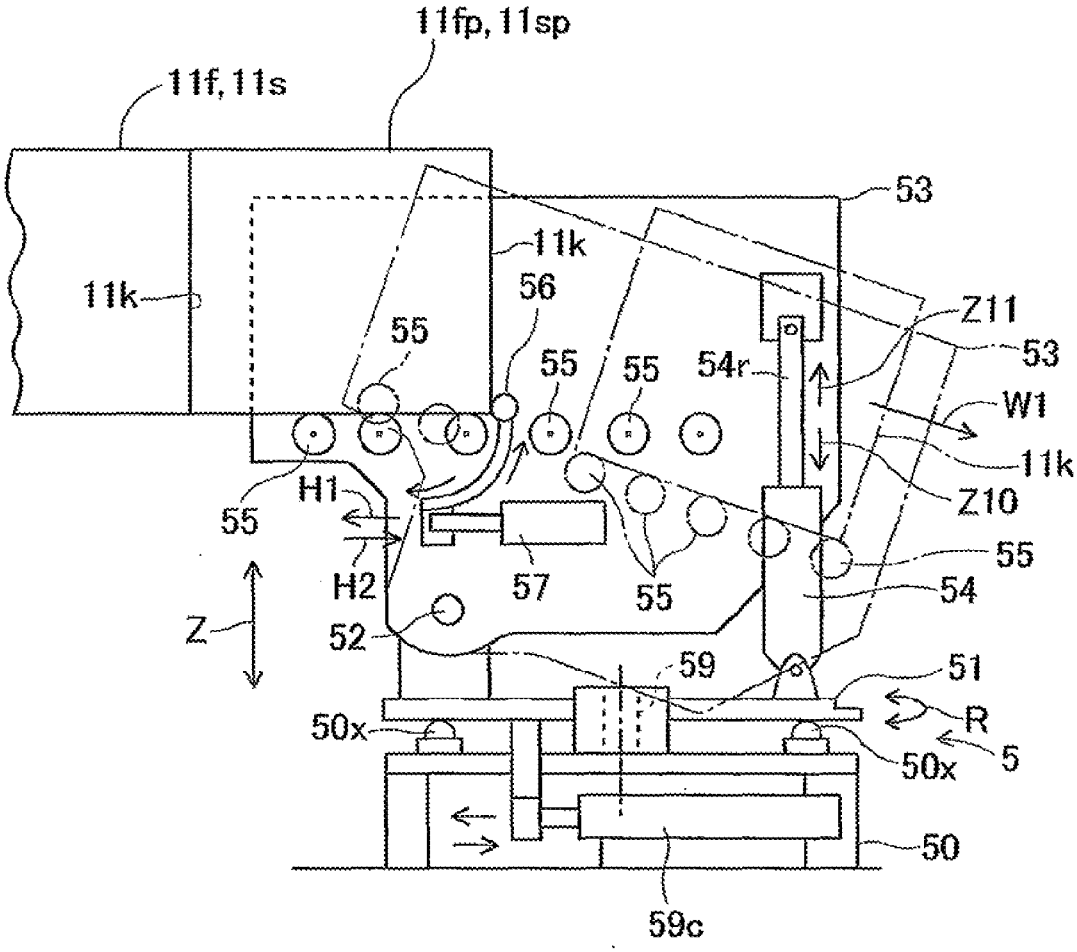
FIG. 11 is a from elevational view schematically showing a die carrying-out device.

The die carrying-out device 5 will be described with reference to FIG. 11. The die carrying-out device 5 comprises a base frame 50 having rotary rollers 50*x*, a rotary frame 51 provided to the base frame 50 so as to be rotatable around the rotary shaft 59 along a horizontal direction (the direction of the arrow R), a tilt frame 53 provided so as to be capable of being tilted in a height direction (the direction of the arrow Z) around a tilt shaft 52 provided to the rotary frame 51 and extending in the horizontal direction, a tilt drive source 54 for tilting the tilt frame 53, a plurality of sliding rollers 55 provided on the tilt frame 53 so as to allow the first die 11*f* and the second die 11*s* to be placed thereon, a stopper 56 constituted by a roller for stopping a carried-out die, and a stopper drive source 57 for switching the stopper 56 between a stop position and a retracted position. When the tilt drive source 54 is actuated in the direction of the arrow Z10, the tilt frame 53 is rotated around the tilt shaft 52 in the direction of the arrow Z10 and tilted. Accordingly, if the stopper 56 is withdrawn, the die 11*f* or 11*s* on the sliding rollers 55 is slid down along the sliding rollers 55 and transferred in the direction of the arrow W1 toward a temporary holding position. If the stopper drive source 57 moves in the direction of the arrow H1, the stopper 56 is withdrawn from the stop position and as a result, does not contact a side surface 11*k* of the die 11*f* or 11*s*. If the stopper drive source 57 moves in a stopper direction (the direction of the arrow H2), the stopper 56 projects upward from the sliding rollers 55 and as a result, can contact the side surface 11*k* of the die 11*f* or 11*s* and stop the die 11*f* or 11*s*. If the tilt drive source 54 is actuated in the direction of the arrow Z11 with the die 11*f*, 11*s* cleared out of the sliding rollers 55, the tilt frame 53 is rotated around the tilt shaft 52 in the direction of the arrow Z11 and returns to its home position. When a rotation drive source 59*c* is driven, the rotary frame 51 is rotated around the rotary shaft 59.

It should be noted that the first clamp drive sources 17*f*, the second clamp drive sources 17*s*, the first die drive source 40*f*, the second die drive source 40*s*, the intersection drive source 7, the first slide drive source 29*f*, the second slide drive source 29*s*, the stopper drive source 57, the tilt drive source 54, the rotation drive source 59*c* mentioned above are respectively constituted by cylinder devices which use fluid pressure such as hydraulic pressure and air pressure, but, in some cases, can be constituted by motor devices.

Figure 13:
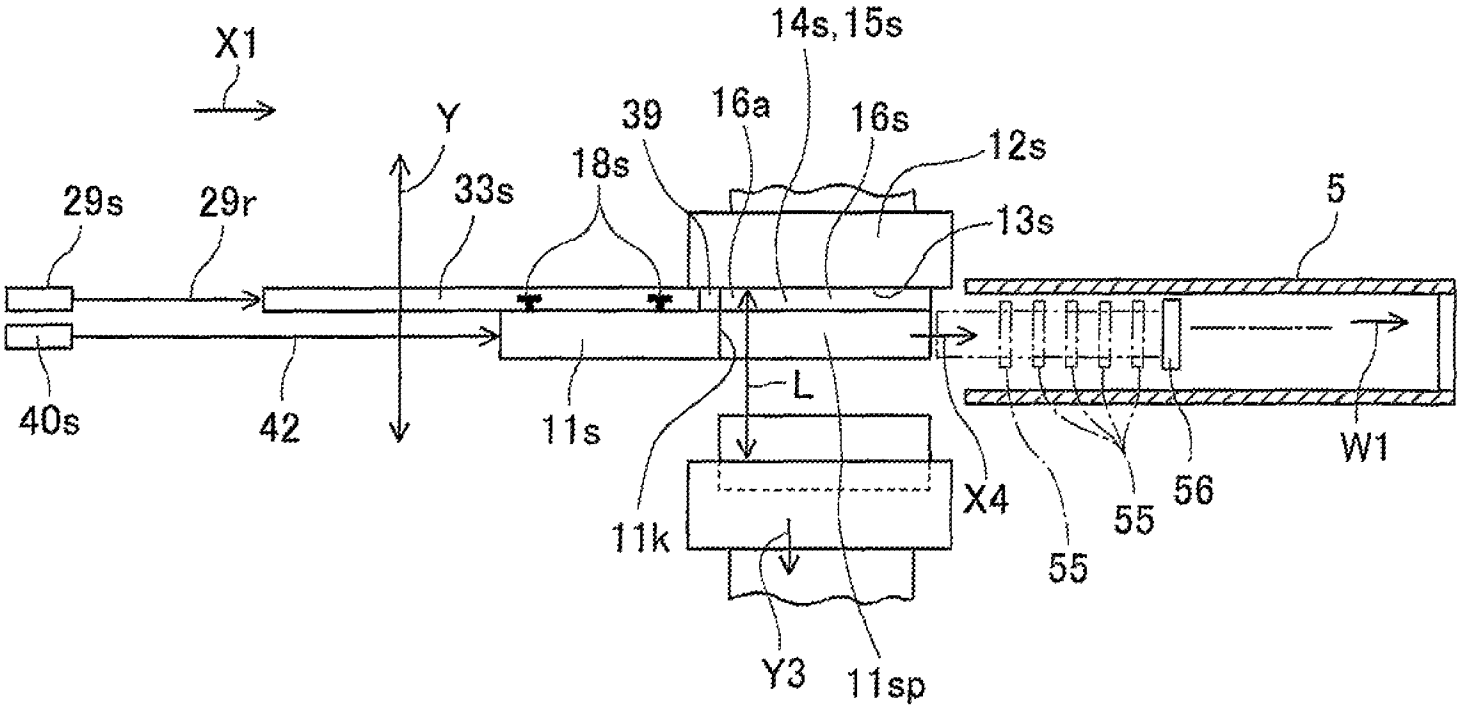
FIG. 13 is a plan view schematically showing a concept in which the second die is mounted on the second die base by means of the second movable plate.

Next, how to use this apparatus will be described. FIG. 12 and FIG. 13 schematically show plan views of a concept of die change. Before die change, a previously-used first die 11*fp* is fixed on the first mounting surface 13*f* of the first die base 12*f*, while a previously-used second die 11*sp* is fixed on the second mounting surface 13*s* of the second die base 12*s*. First of all, procedure for changing the previously-used first die 11*fp* will be described. As shown in FIG. 2, the first clamp drive sources 17*f* are actuated to cause the first clamping members 15*f* to move in a detachment direction (the direction of the arrow W2). As a result a rear surface 11*b* of the previously-used first die 11*fp* is separated from the first mounting surface 13*f* of the first die base 12*f* to form a first gap 19*f* and place the previously-used first die 11*fp* in an exchangeable position (see FIG. 2). At this time, the previously-used first die 11*fp* faces the first movable plate 33*f* in the back of the first gap 19*f*. In this case, the first clamping members 15*f* and the first movable plate 33*f* are aligned with each other in the direction of the arrow Y (a direction connecting the first die base 12*f* and the second die base 12*s*) (see FIG. 12). Accordingly, the first clamping members 15*f* and the first movable plate 33*f* face each other in the die carrying-in direction (the direction of the arrow X1) (see FIG. 12). In such a situation, as can be understood from FIG. 12, the first slide drive source 29*f* is actuated to cause the first movable frame 22*f* together with a new first die 11*f* and the first movable plate 33*f* to slide in the die carrying-in direction (the direction of the arrow X1).

In this case, as shown in FIG. 12, the second movable plate 33*s* is approximately aligned with the second die base 12*s* in the direction of the arrow Y. Accordingly, if the second movable plate 33*s* advances in the direction of the arrow X1, the second movable plate 33 will collide against the second die base 12*s*. Therefore, although the first movable plate 33*f* is caused to advance in the die carrying-in direction (the direction of the arrow X1), the second movable plate 33*s* is kept stopped.

When the first movable plate 33*f* advances in the direction of the arrow X1 as mentioned above, the position restricting portions 39 at the fore end side of the first movable plate 33*f* get engaged with the leading ends 16*a* of the clamping members 15*f* of the clamping elements 14*f*, thereby determining the position of the first die 11*f* in the height direction (the direction of the arrow Z). This inhibits the first movable plate 33*f* from being further moved and stops the first movable plate 33*f*. After that, the first die drive source 40*f* is actuated to extend its rod 42 in the direction of the arrow X1 and cause the new first die 11*f* to be carried in along the die carrying-in direction (the direction of the arrow X1). Since at this time the position of the new first die 11*f* has been determined in the height direction (the direction of the arrow Z) as mentioned before, the first engaging portions 18*f* of the new first die 11*f* are guided to predetermined positions while being well fitted into the first guide grooves 16*f* of the first clamping members 15*f* (see FIG. 6). Since the second die drive source 40*s* is not actuated at this time, a new second die 11*s* is kept stopped.

As a result, as shown in FIG. 12, a side surface 11*k* of the new first die 11*f* presses the previously-used first die 11*fp* in the die carrying-out direction (the direction of the arrow X4). In this case, as shown in FIG. 11 and FIG. 12, the previously-used first die 11*fp* is transferred from the first die base 12*f* to the sliding rollers 55 of the die carrying-out device 5 and brought in contact with the stopper 56. After that, the tilt drive source 54 is actuated to retract its rod 54*r* in the direction of the arrow Z10, thereby lowering the tilt frame 53 around the tilt shaft 52 in the direction of the arrow Z10. As a result, the previously-used first die 11*fp* is slid downward in the direction of the arrow W1 to a retracted position by means of the sliding rollers 55. In such a situation, as shown in FIG. 2, the first engaging portions 18*f* of the new first die 11*f* are fitted into the first guide grooves 16*f* of the first clamping members 15*f*.

In such a situation, as can be understood from FIG. 2 and FIG. 3, the first clamp drive sources 17*f* are actuated in the direction of the arrow W1 to retreat the first clamping members 15*f* in the same direction. This causes the rear surface 11*b* of the new first die 11*f* to be in close contact with the first mounting surface 13*f* and clamped, and completes change with the new first die 11*f* (see FIG. 3). In this case, the first engaging portions 18*f* on the rear surface 11*b* of the new first die 11*f* are fitted into the first guide grooves 16*f* and positioned in the height direction (the direction of the arrow Z). As mentioned before, while the previously-used first die 11*fp* is carried out to the die carrying-out device 5, the new first die 11*f* can be mounted on the first die base for replacement.

Next, an operation to change the previously-used second die 11*sp* with a new second die 11*s* will be started. In this situation, as shown in FIG. 4, the second engaging portions 18*s* of the previously-used second die 11*sp* are fitted into the second guide grooves 16*s* of the second clamping members 15*s*. In this case, the rod 71 of the intersection drive source 7 is driven to move the second movable frame 22*s* in the direction of the arrow Y (a perpendicular direction to the direction of the arrow X1 within an imaginary horizontal plane) as shown in FIG. 12. As a result, as shown in FIG. 13, the second movable plate 33*s* and the second clamping members 15*s* are aligned with each other in the direction of the arrow Y. As a result, the second die 11*s* held by the second movable plate 33*s* and the second mounting surface 13*s* of the second die base 12*s* are approximately aligned with each other. Furthermore, the first die base 12*f* on which the first die 11*f* is mounted is withdrawn in a retracted direction (the direction of the arrow Y3, see FIG. 12) so as to be separated from the second die base 12*s*.

Similarly to the above, as shown in FIG. 4, the second clamp drive sources 17*s* are actuated to advance the rods 172 and move the second clamping members 15*s* in a detachment direction (the direction of the arrow W2). As a result, a rear surface 11*b* of the previously-used second die 11*sp* is separated from the second mounting surface 13*s* of the second die base 12*s* to form a second gap 19*s* and place the previously-used second die 11*sp* in an exchangeable position (see FIG. 4). At this time, the second movable plate 33*s* is present in the back of the second gap 19*s*. That is to say, the second movable plate 33*s* and the second clamping members 15*s* face each other in the direction of the arrow X1 (see FIG. 13).

Next, as shown in FIG. 13, the second slide drive source 29*s* is actuated to extend its rod 29*r* in the die carrying-in direction (the direction of the arrow X1). This causes the second movable frame 22*s* (not shown in FIG. 13) together with the second die 11*s* and the second movable plate 33*s* to slide along the die carrying-in direction (the direction of the arrow X1) toward the second mounting surface 13*s* of the second die base 12*s*. At this time, the position restricting portions 39 at the fore end side of the second movable plate 33*s* get engaged with the leading ends 16*a* of the clamping members 15*s*, thereby determining the position of the second die 11*s* in the height direction (the direction of the arrow Z). The second movable plate 33*s* cannot advance in the direction of the arrow X1 any further and stops.

After that, as shown in FIG. 13, the second die drive source 40*s* is actuated to extend the rod 42 in the direction of the arrow X1 to cause the new second die 11*s* to be detached from the second movable plate 33*s* and carried in along the die carrying-in direction (the direction of the arrow X1). Since at this time the position of the second die 11*s* has been determined in the height direction (the direction of the arrow Z) as mentioned before, the second engaging portions 18*s* of the second die 11*s* are guided to predetermined positions while being well fitted into the second guide grooves 16*s* of the second clamping members 15*s* (see FIG. 6). As a result, as shown in FIG. 13, a side surface 11*k* of the second die 11*s* presses the previously-used second die 11*sp* in the die carrying-out direction (the direction of the arrow X4). In this case, as shown in FIG. 11, the previously-used second die 11*sp* is transferred from the second die base 12*s* to the sliding rollers 55 of the die carrying-out device 5 and brought in contact with the stopper 56. After that, the tilt drive source 54 is actuated to retract its rod 54*r* in the direction of the arrow Z10, lower the tilt frame 53 around the tilt shaft 52 in the direction of the arrow Z10, and slide the previously-used second die 11*sp* downward by means of the sliding rollers 55. Furthermore, as shown in FIG. 5, the second clamp drive sources 17*s* are actuated in the direction of the arrow W1 to move the second clamping members 15*s* in the same direction. This causes the rear surface 11*b* of the new second die 11*s* to be pressed against the second mounting surface 13*s* and clamped. In this case, the second engaging portions 18*s* on the rear surface 11*b* of the new second die 11*s* are positioned while being fitted into the second guide grooves 16*s* of the second clamping members 15*s*.

The above mentioned position restricting portions 39 of the fore end of the second movable plate 33*s* are engaged with the leading ends 16*a* of the clamping member 15*s*, thereby determining the position of the second die 11*s* in the height direction (the direction of the arrow Z). Therefore, the second engaging portions 18*s* of the second die 11*s* are well fitted into the second guide grooves 16*s* of the second clamping members 15*s* and guided to predetermined positions. Next, the second clamp drive sources 17*s* are actuated to move the second clamping members 15*s* in the retracted direction (the direction of the arrow W1). As a result, the rear surface 11*b* of the second die 11*s* is pressed against the second mounting surface 13*s* of the second die base 12*s* and fixed.

As mentioned above, according to the present embodiment, first, one of the first die 11*f* and the second die 11*s*, say, the first die 11*f* is mounted on the first die base 12*f*. After that, the first die base 12*f* on which the first die 11*f* is mounted is moved in the retracted direction (the direction of the arrow Y3 in FIG. 12) and withdrawn. After that, the intersection drive source 7 causes the second movable plate 33*s* having the other die, i.e., the second die 11*s* to move in the direction (the direction of the arrow Y) to intersect the die carrying-in direction (the direction of the arrow X1). In such a situation, the other die, i.e., the second die 11*s* is mounted on the second die base 12*s*. According to the present embodiment thus constructed, even when the distance L between the first die base 12*f* and the second die base 12*s* is not great in the molding machine 1, change with a first die 11*f* or a second die 11*s* having a greater thickness can be realized.

Others

According to the abovementioned embodiment, first of all, the first die 11*f* is mounted on the first die base 12*f*, and then the second die 11*s* is mounted on the second die base 12*s*. However, this order can be reversed. The present invention is not limited to the embodiment discussed above, and can be carried out with appropriate changes without departing from the spirit of the present invention. For example, motor devices can be used instead of the cylinder devices using fluid pressure.

The invention claimed is:

1. A die change apparatus for use in a flaskless molding machine, comprising a flaskless molding machine capable of being equipped with a first die and a second die for producing a flaskless casting mold, and a die carrying-in device and a die carrying-out device provided so as to face each other across the flaskless molding machine, (i) the flaskless molding machine comprising:

a) a first die base having a first mounting surface and a second die base having a second mounting surface;

b) a first clamping element provided on the first die base and being switchable between a clamp position to fix the first die on the first mounting surface and an unclamp position to release clamping and separate the first die from the first mounting surface; and c) a second clamping element provided on the second die base and being switchable between a clamp position to fix the second die on the second mounting surface and an unclamp position to release clamping and separate the second die from the second mounting surface, and (ii) the die carrying-in device comprising:

a) a first movable plate provided so as to be slidable along a die carrying-in direction toward the first mounting surface of the first die base, and having a first positioning portion for detachably supporting the first die and positioning the first die in a height direction;

b) a second movable plate placed so as to face the first movable plate in a standby position, provided so as to be slidable along the die carrying-in direction toward the second mounting surface of the second die base independently of the first movable plate, and having a second positioning portion for detachably supporting the second die positioning the second die a the height direction;

c) a die drive source for causing the first die which has been positioned in the height direction by the first positioning portion to be detached from the first movable plate, move along the die carrying-in direction toward the first mounting surface of the first die base and be supported by the first clamping element, and causing the second die which has been positioned in the height direction by the second positioning portion to move along the die carrying-in direction toward the second mounting surface of the second die base independently of the first die and be supported by the second clamping element; and d) an intersection drive source for causing at least one of the first movable plate and the second movable plate to move in a direction to intersect the die carrying-in direction independently of the other.

2. The die change apparatus for use in a flaskless molding machine according to claim 1, wherein the die carrying-in device comprises a fixed frame; a first movable frame and a second movable frame provided on the fixed frame so as to be slidable along the die carrying-in direction; a first slide drive source provided on the fixed frame and causing the first movable frame to slide along the die carrying-in direction independently of the second movable frame; and a second slide drive source provided on the fixed frame and causing the second movable frame to slide along the die carrying-in direction independently of the first movable frame.

3. The die change apparatus for use in a flaskless molding machine according to claim 1, wherein:

the first clamping element comprises a first clamping member provided on the first die base and being switchable between the clamp position to fix the first die on the first mounting surface and the unclamp position to release clamping and separate the first die from the first mounting surface, a first guide groove provided on the first clamping member and guiding a first engaging portion provided on a rear surface of the first die along the die carrying-in direction, and a first clamp drive source for switching the first clamping member between the clamp position and the unclamp position; and the second clamping element comprises a second clamping member provided on the second die base and being switchable between the clamp position to fix the second die on the second mounting surface and the unclamp position to release clamping and separate the second die from the second mounting surface, a second guide groove provided on the second clamping member and guiding a second engaging portion provided on a rear surface of the second die along the die carrying-in direction, and a second clamp drive source for switching the second clamping member between the clamp position and the unclamp position.

4. A die carrying-in device for inserting a first die and a second die capable of producing a flaskless casting mold into a flaskless molding machine capable of being equipped with the first die and the second die, (i) the flaskless molding machine comprising:

a) a first die base having a first mounting surface and a second die base having a second mounting surface;

b) a first clamping element provided on the first die base and being switchable between a clamp position to fix the first die on the first mounting surface and an unclamp position to release clamping and separate the first die from the first mounting surface;

c) a second clamping element provided on the second die base and being switchable between a clamp position to fix the second die on the second mounting surface and an unclamp position to release clamping and separate the second die from the second mounting surface, and (ii) the die carrying-in device comprising:

a first movable plate provided so as to be slidable along a die carrying-in direction toward the first mounting surface of the first die base, and having a first positioning portion for detachably supporting the first die and positioning the first die in a height direction;

b) a second movable plate placed so as to face the first movable plate in a standby position, provided so as to be slidable along the die carrying-in direction toward the second mounting surface of the second die base independently of the first movable plate, and having a second positioning portion for detachably supporting the second die and positioning the second die in the height direction;

c) a die drive source for causing the first die which has been positioned in the height direction by the first positioning portion to be detached from the first movable plate, move along the die carrying-in direction toward the first mounting surface of the first die base, and be supported by the first clamping element, and causing the second die which has been positioned in the height direction by the second positioning portion to move along the die carrying-in direction toward the second mounting surface of the second die base independently of the first die, and be supported by the second clamping element; and d) an intersection drive source for causing at least one of the first movable plate and the second movable plate to move in to direction to intersect the die carrying-in direction independently of the other.

* * * * *